US007614371B2

(12) United States Patent
Gecim

(10) Patent No.: US 7,614,371 B2
(45) Date of Patent: Nov. 10, 2009

(54) ENGINE VALVETRAIN HAVING VARIABLE VALVE LIFT TIMING AND DURATION

(75) Inventor: Burak A. Gecim, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 327 days.

(21) Appl. No.: 11/671,491

(22) Filed: Feb. 6, 2007

(65) Prior Publication Data

US 2008/0184947 A1 Aug. 7, 2008

(51) Int. Cl.
*F01L 1/34* (2006.01)

(52) U.S. Cl. ..... 123/90.15; 123/90.17; 123/90.31

(58) Field of Classification Search ..... 123/90.15, 123/90.16, 90.17, 90.31
See application file for complete search history.

(56) References Cited

U.S. PATENT DOCUMENTS

| | | | | |
|---|---|---|---|---|
| 5,992,361 | A | 11/1999 | Murata et al. | |
| 6,328,006 | B1 * | 12/2001 | Heer | 123/90.15 |
| 2002/0170513 | A1 * | 11/2002 | Willmot | 123/90.15 |
| 2005/0211207 | A1 * | 9/2005 | Urushihata et al. | 123/90.17 |

* cited by examiner

*Primary Examiner*—Zelalem Eshete

(57) ABSTRACT

An engine includes a crankshaft, a first noncircular gear operatively connected to the crankshaft to be driven thereby, a second noncircular gear meshingly engaged with the first noncircular gear, a cam operatively connected to the second noncircular gear to be driven thereby, and a valve operatively connected to the cam for movement between open and closed positions. The noncircular gears enable the speed of the cam to vary cyclically with constant rotation of the crankshaft speed. Valve lift timing and duration may be variable by moving the second noncircular gear with respect to the first noncircular gear while maintaining meshing engagement therebetween.

16 Claims, 4 Drawing Sheets

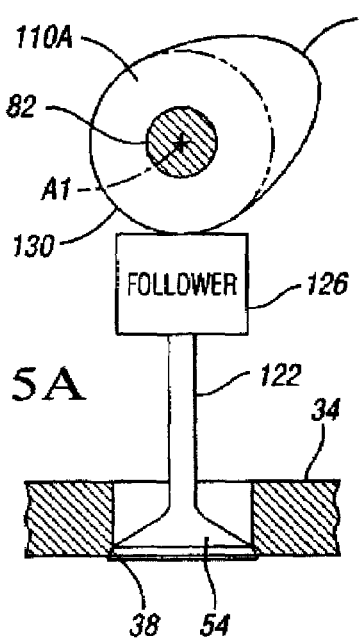
FIG. 5A
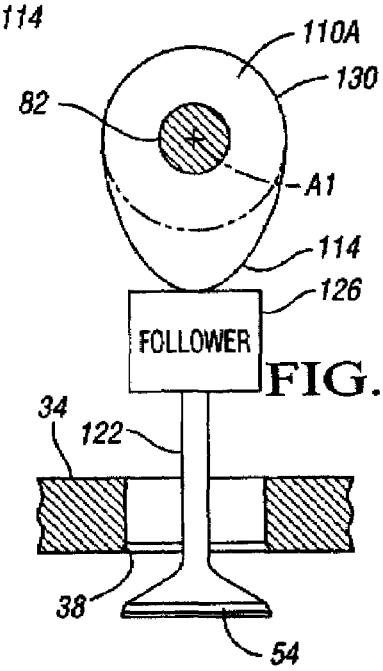
FIG. 5B
FIG. 6
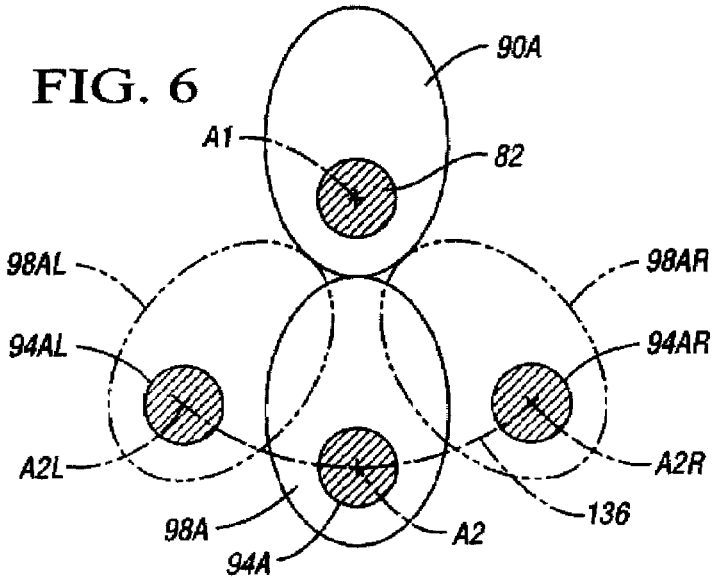
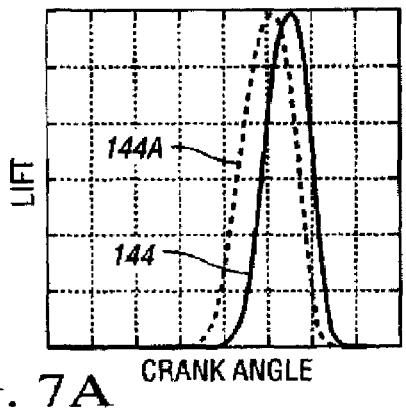
FIG. 7A
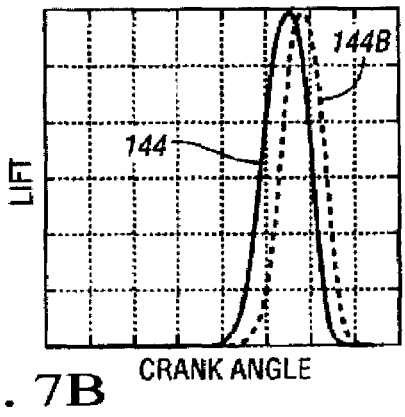
FIG. 7B

ENGINE VALVETRAIN HAVING VARIABLE VALVE LIFT TIMING AND DURATION

TECHNICAL FIELD

This invention relates to engine valvetrains having noncircular gears operatively interconnecting a crankshaft and a cam such that the cam is characterized by cyclically varying rotational speed with constant crankshaft speed.

BACKGROUND OF THE INVENTION

Certain prior art engines include variable valve timing (VVT) and variable valve lift valve actuating mechanisms to reduce pump work and valve train friction, to control engine load and internal exhaust dilution, to improve charge preparation, to increase peak power, and to enable the use of various transient operation control strategies not otherwise available.

SUMMARY OF THE INVENTION

An engine includes a rotatable crankshaft, a first gear operatively connected to the crankshaft to be driven thereby, a second gear meshingly engaged with the first gear to be driven thereby, a rotatable cam operatively connected to the second gear to be driven thereby, and a valve being selectively movable between open and closed positions and being operatively connected to the cam such that rotation of the cam causes movement of the valve between the open and closed positions. The first and second gears are configured such that, when the rotational speed of the crankshaft is constant, the rotational speed of the second gear, and, correspondingly, the rotational speed of the cam, varies cyclically with the crank angle position of the crankshaft.

The timing of a lift event of the valve is selectively variable by altering the relationship between the rotational position of the cam and the rotational position of the crankshaft; the duration of a lift event is selectively variable by altering the relationship between the speed cycle of the cam and the rotational position of the cam relative to the valve or cam follower, i.e., the duration of a lift event of the valve is selectively variable by altering when, during the speed cycle of the cam, the cam causes movement of the valve to its open position.

In an exemplary embodiment, the axis of rotation of the second gear is selectively movable with respect to the axis of rotation of the first gear to enable both a change in the relationship between the rotational position of the cam and the rotational position of the crankshaft, and a change in the relationship between the speed cycle of the cam and the position of the cam relative to the valve or cam follower, thereby to enable a change in both the timing and duration of a lift event of the valve.

The engine provided herein has fewer parts and more precise control than prior art engines that have cyclically varying cam speeds. The engine provided herein may also have reduced friction compared to the prior art because the engine provided herein has fewer sliding contacts than the prior art.

The above features and advantages, and other features and advantages of the present invention are readily apparent from the following detailed description of the best modes for carrying out the invention when taken in connection with the accompanying drawings.

BRIEF DESCRIPTION OF THE DRAWINGS

FIG. 5A is a schematic side view of a cam of FIG. 2 and a valve of FIG. 1 in a configuration in which the valve is closed;

FIG. 5B is a schematic side view of the cam and valve of FIG. 5A in a configuration in which the valve is opened;

FIG. 6 is a schematic side view of the eccentric gears of FIGS. 2 and 3A-3C depicting movement of the support shaft of one of the eccentric gears between first, second, and third positions;

FIG. 7A is a graph schematically depicting the relationships between valve lift and crank angle position of the crankshaft with the support shaft of FIG. 6 in the first position and the second position; and FIG. 7B is a graph schematically depicting the relationships between valve lift and crank angle position of the crankshaft with the support shaft of FIG. 6 in the first position and the third position.

DESCRIPTION OF THE PREFERRED EMBODIMENTS

Figure 1:
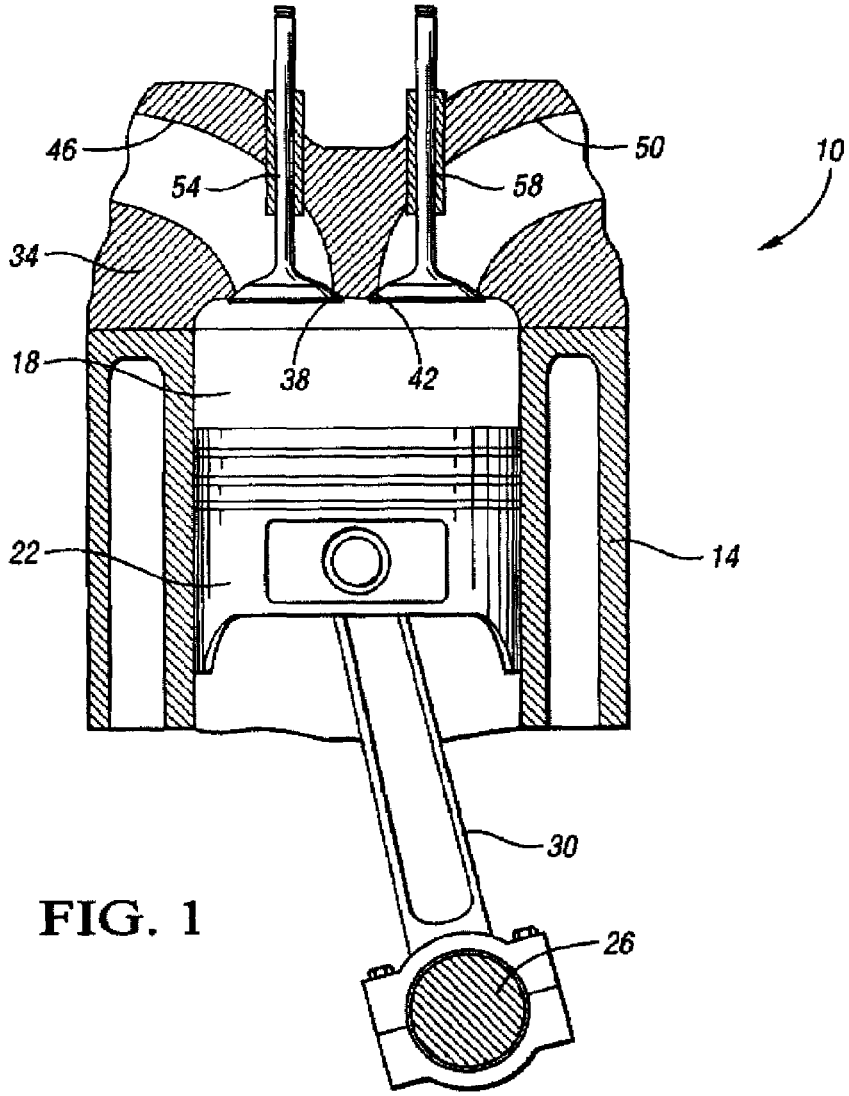
FIG. 1 is a schematic, cross-sectional side view of part of an internal combustion engine including a crankshaft and intake and exhaust valves.

Referring to FIG. 1, an internal combustion engine 10 is schematically depicted. The engine 10 includes an engine block 14 defining a plurality of cylinders 18, only one of which is shown in FIG. 1. Each cylinder 18 has a respective piston 22 positioned therein for reciprocating translation, as understood by those skilled in the art. Each piston 22 is connected to a crankshaft 26 by a respective connecting rod 30.

A cylinder head 34 defines an intake port 38 and an exhaust port 42 for each cylinder 18, as understood by those skilled in the art. Each intake port 38 provides selective fluid communication between a respective cylinder 18 and an air intake system (not shown) via a respective runner 46. Each exhaust port 42 provides selective fluid communication between a respective cylinder 18 and an exhaust manifold (not shown) via a respective runner 50. Each of the intake ports 38 has a respective intake valve 54 associated therewith. Each intake valve 54 is moveable between a closed position in which the intake valve obstructs a respective intake port 38 and an open position in which the intake valve allows fluid communication through the respective intake port 38, as understood by those skilled in the art. Similarly, each exhaust port 42 has an exhaust valve 58 associated therewith. Each exhaust valve 58 is selectively moveable between a closed position in which the exhaust valve 58 obstructs a respective exhaust port 42, and an open position in which the exhaust valve 58 allows fluid communication through the respective exhaust port 42.

Figure 2:
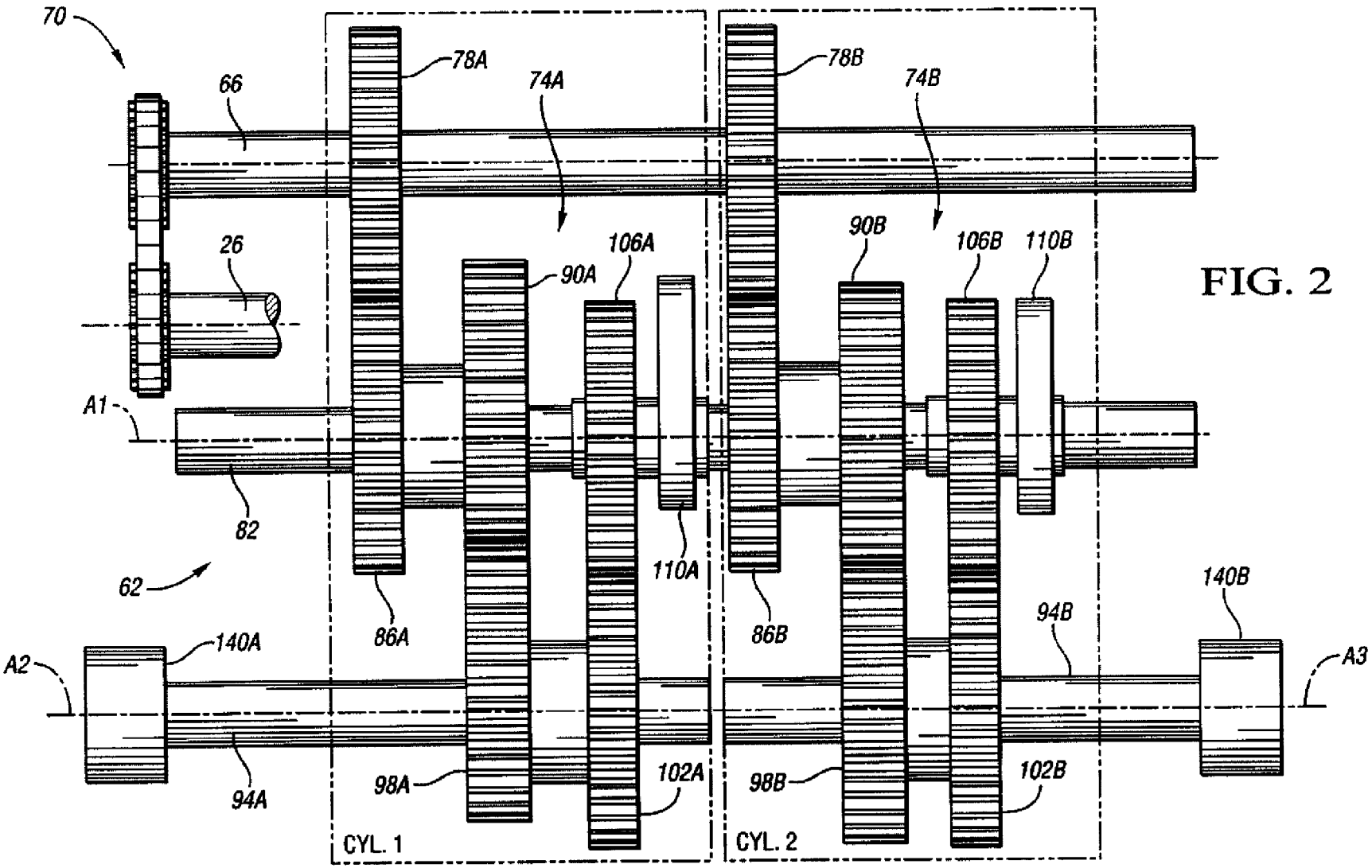
FIG. 2 is a schematic top view of part of a valvetrain including two cams configured to enable valves associated with two of the cylinders of the engine of FIG. 1 to open and close.

Referring to FIG. 2, a valvetrain 62 for the engine 10 is schematically depicted. The valvetrain 62 includes an input member, namely, input shaft 66. The input shaft 66 is operatively connected to the crankshaft 26 of the engine 10, such as via a chain drive 70, as understood by those skilled in the art, such that the input shaft 66 rotates at half the speed of the crankshaft 26.

The valvetrain 62 is characterized by a geartrain for each cylinder valve in the engine (shown at 10 in FIG. 1); two exemplary geartrains 74A, 74B are depicted in FIG. 2. Geartrain 74A causes an intake or exhaust valve for a first cylinder to open and close, and geartrain 74B causes an intake or exhaust valve for a second cylinder to open and close. Geartrain 74A includes a gear 78A mounted to the input shaft 66 for rotation therewith. A support member, namely support shaft 82, rotatably supports gear 86A such that gear 86A is rotatable about an axis A1 that is coextensive with the support shaft 82. Gear 86A is meshingly engaged with gear 78A to be driven thereby. Gear 90A is rotatably supported by the support shaft 82 and is mounted to gear 86A for rotation therewith about axis A1. In the embodiment depicted, gears 78A and 86A are characterized by a 1:1 ratio, and therefore gear 86A and gear 90A rotate at the same speed as the input shaft 66, and at one half of the crankshaft speed.

An intermediate shaft 94A rotatably supports gear 98A such that the gear 98A is rotatable about an axis A2 that is coextensive with the intermediate shaft 94A. Gear 98A is meshingly engaged with gear 90A to be driven thereby. A gear 102A is rotatably supported by the intermediate shaft 94A and is mounted to gear 98A for rotation therewith.

The support shaft 82 rotatably supports gear 106A for rotation about axis A1. Gear 106A is meshingly engaged with gear 102A to be driven thereby. A cam 110A is rotatably supported by the support shaft 82, and is mounted to the gear 106A for rotation therewith about axis A1. The gears 102A and 106A are characterized by a 1:1 ratio in the embodiment depicted, and therefore the cam 10A and the gear 106A rotate at the same speed as gears 102A and 98A. In a multi-valve engine, another cam (not shown) may be placed symmetrically on the opposite side of gear 106A from cam 110A.

Geartrain 74B includes a gear 78B mounted to the input shaft 66 for rotation therewith. Support shaft 82 rotatably supports gear 86B such that gear 86B is rotatable about axis A1. Gear 86B is meshingly engaged with gear 78B to be driven thereby. Gear 90B is rotatably supported by the support shaft 82 and is mounted to gear 86B for rotation therewith about axis A1. In the embodiment depicted, gears 78B and 86B are characterized by a 1:1 ratio, and therefore gear 86B and gear 90B rotate at the same speed as gear 78B and the input shaft 66, and at one half of the crankshaft speed.

Intermediate shaft 94B rotatably supports gear 98B such that gear 98B is rotatable about axis A3. Gear 98B is meshingly engaged with gear 90B to be driven thereby. A gear 102B is rotatably supported by the intermediate shaft 94B and is mounted to gear 98B for rotation therewith.

The support shaft 82 rotatably supports gear 106B for rotation about axis A1. Gear 106B is meshingly engaged with gear 102B to be driven thereby. A cam 110B is rotatably supported by the support shaft 82, and is mounted to gear 106B for rotation therewith about axis A1. The gears 102B and 106B are characterized by a 1:1 ratio in the embodiment depicted, and therefore the cam 110B and the gear 106B rotate at the same speed as gears 102B and 98B. Axes A1, A2, and A3 are parallel to one another. Axis A2 and axis A3 may be coextensive.

The valvetrain 62 is configured such that the rotational speed of cams 110A, 110B vary cyclically with a constant rotational speed of crankshaft 26. In the embodiment depicted, this is accomplished by gears 90A, 90B and 98A, 98B being noncircular and, more particularly elliptical, although other noncircular gear shapes may be employed within the scope of the claimed invention. Further, gears 90A, 90B, 98A, 98B rotate about axes that are not located at their geometric center. Accordingly, gears 90A, 90B, 98A, 98B may be referred to hereinafter as "eccentric gears." Since gears 90A, 90B drive gears 98A, 98B, respectively, gears 90A, 90B may be referred to hereinafter as "input eccentric gears" and gears 98A, 98B may be referred to hereinafter as "output eccentric gears."

Figure 3A:
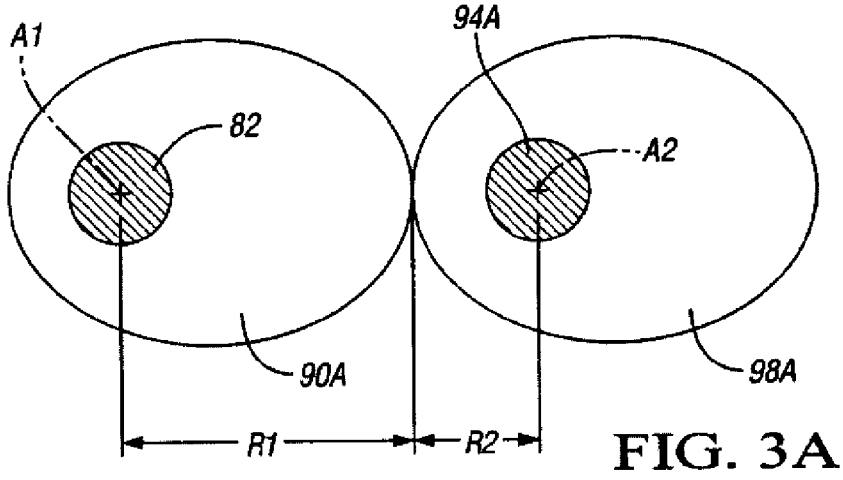
FIG. 3A is a schematic side view of two eccentric gears from the valvetrain of FIG. 2 in a progressive first configuration.
Figure 3B:
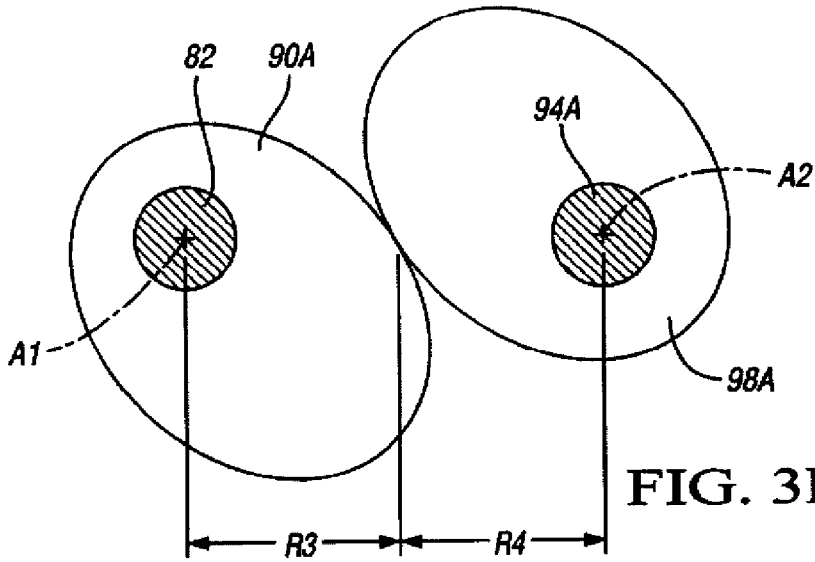
FIG. 3B is a schematic side view of the two eccentric gears of FIG. 3A in a progressive second configuration.
Figure 3C:
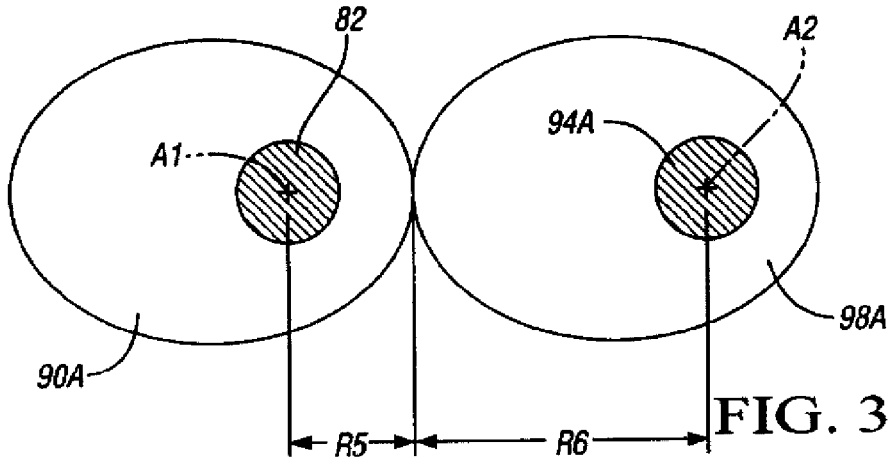
FIG. 3C is a schematic side view of the two eccentric gears of FIGS. 3A and 3B in a progressive third configuration.

FIGS. 3A-C depict input eccentric gear 90A and output eccentric gear 98A in three different mesh positions during a one-half rotation of the input eccentric gear 90A. The eccentric gears 90A and 98A are depicted without teeth for graphical simplicity. The gears 90A, 98A are depicted as being rotatably supported directly on shafts 82, 94A, respectively; however, those skilled in the art will recognize that it may be desirable to employ bearings, such as roller bearings or journal bearings, between a shaft and a member that is rotatably supported thereby.

The rotational speed of the output eccentric gear 98A is related to the rotational speed of the input eccentric gear 90A by the following equation: $\omega_{output}=\omega_{input}(r_{input}/r_{output})$ where $\omega_{output}$ is the rotational speed of the output eccentric gear 98A, ($\omega_{input}$ is the rotational speed of the input eccentric gear 90A, $r_{input}$ is the radius of the input eccentric gear 90A, and $r_{output}$ is the radius of the output eccentric gear 98A. As used herein, the radius of an eccentric gear refers to the distance between the axis of rotation of the eccentric gear and the point of engagement with the other eccentric gear. Thus, the input radius, i.e., the radius of the input eccentric gear 90A, is the distance from the axis A1 to the point at which the input eccentric gear 90A engages the output eccentric gear 98A. Similarly, the output radius, i.e., the radius of the output eccentric gear 98A, is the distance between axis A2 and the point at which the output eccentric gear 98A engages the input eccentric gear 90A.

The input radius and the output radius of gears 90A, 98A vary during rotation of the gears. Referring specifically to FIG. 3A, the input radius, i.e., the distance R1 between the point at which the output eccentric gear 98A engages the input eccentric gear 90A and axis A1, is at its maximum value. The output radius, i.e. the distance R2 between the point at which the input eccentric gear 90A engages the output eccentric gear and axis A2, is at its minimum value, R2. Accordingly with the input radius being at its maximum value R1, and with the output radius being at its minimum value R2 and significantly smaller than the input radius, the rotational speed of the output eccentric gear 98A relative to the rotational speed of the input eccentric gear 90A is at its maximum value.

Referring to FIG. 3B, the input eccentric gear 90A and the output eccentric gear 98A have rotated from their respective positions in FIG. 3A to an equal speed configuration. The input radius has a value of R3, and the output radius has a value of R4. R3 and R4 are identical, and therefore the rotational speed of the output eccentric gear 98A is the same as the rotational speed of the input eccentric gear 90A. Referring to FIG. 3C, the input eccentric gear 90A has rotated 180 degrees from its position in FIG. 3A, and the output eccentric gear 98A has rotated 180 degrees from its position in FIG. 3A. The input radius is at its minimum value R5, and the output radius is at its maximum value R6. Gears 90A and 98A are the same size and shape in the embodiment depicted, and thus R5 equals R2, and R6 equals R1. With the input radius being at its minimum value R5, and with the output radius being at its maximum value and significantly greater than R5, the rotational speed of the output eccentric gear 98A relative to the input eccentric gear 90A is at its minimum value.

Figure 4:
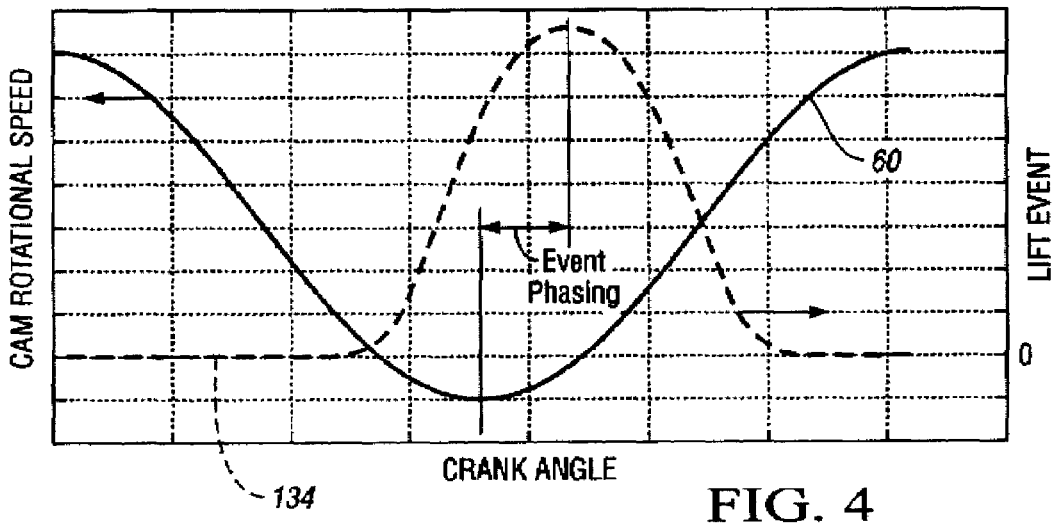
FIG. 4 is a graph that schematically depicts the relationship between the rotational speed of a cam of FIG. 2, the amount of lift of a valve of FIG. 1, and the crank angle position of the crankshaft of FIG. 1.

Accordingly, given a constant rotational speed of the input eccentric gear 90A, the rotational speed of the output eccentric gear 98A will fluctuate cyclically. Referring again to FIG. 2, the output eccentric gear 98A drives the cam 110A via gear 102A and gear 106A. Gear 102A is mounted to the output eccentric gear 98A, and therefore rotates at the same speed as the output eccentric gear 98A. Gear 102A and gear 106A have a 1:1 ratio, and therefore, the cam 110A rotates at the same speed as the output eccentric gear 98A and will have the same cyclic speed fluctuation as the output eccentric gear 98A. Referring to FIG. 4, line 60 depicts an exemplary relationship between the rotational speed of the cam 110A and crank angle degrees of the crankshaft over two rotations of the crankshaft, i.e., 720 crank angle degrees.

The relationship depicted by line 60 assumes a constant rotational speed of the input eccentric gear 90A and, correspondingly, the crankshaft 26. Since the input eccentric gear 90A rotates at one half of the rotational speed of the crankshaft, the relationship shown in FIG. 4 depicts the relationship between the rotational speed of the output eccentric gear 98A and cam 110A with respect to crank angle degrees over one rotation of the input eccentric gear 90A. As understood by those skilled in the art, the cam 110A rotates once for every two rotations of the crankshaft in a four-stroke engine. In order to maintain one cam rotation over two crankshaft rotations, the profiles of the input eccentric gear 90A and the output eccentric gear 98A must yield an output speed function that, upon integration over two crankshaft rotations, will yield one cam rotation. The cyclic variation shown in FIG. 4 satisfies this condition.

Concerning the gear pitch profiles, the averaged value of the radii ratio is unity, assuming that the input eccentric gear 90A is rotating at half the crankshaft speed. The speed ratio between the crankshaft 26 and the input shaft 66, and the speed ratio between gear 78A and 86A, can have any value as long as the overall cycle-averaged crankshaft to cam ratio satisfies the 2-to-1 ratio requirement. Also, in the embodiment depicted, the summation of the pitch radii at each mesh position of the input eccentric gear and the output eccentric gear should equal the fixed center distance between axes A1 and A2 so that the gears 90A and 98A mesh continuously throughout their rotations. The output eccentric gear 98A, and therefore the cam 110A speed profile can selectively be designed to be more or less aggressive, i.e., the amplitude deviation from the average cam speed value can be controlled by the pitch profiles of eccentric gears 90A and 98A. An aggressive cam speed profile will yield a larger variation in duration with less phasing authority.

Referring to FIG. 5A, wherein like reference numbers refer to like components from FIGS. 1-3, cam 110A is characterized by a lobe 114. Intake valve 54 is biased by a spring (not shown) in a closed position, as depicted in FIG. 5A, in which the valve obstructs cylinder port 38. The valve stem 122 contacts a cam follower 126, which is depicted highly schematically in FIG. 5A. A cam follower may have any configuration within the scope of the claimed invention; those skilled in the art will recognize a variety of cam followers that may be employed, such as finger followers, end-loaded followers, center-pivoted followers, etc. The cam follower 126 contacts the cam 110A, as understood by those skilled in the art. When the cam follower 126 is in contact with the base circle portion 130 of the cam 110A, as depicted in FIG. 5A, the valve 54 remains in the closed position. When the cam 110A rotates such that the lobe 114 contacts the cam follower 126, as shown in FIG. 5B, the lobe exerts a force on the cam follower, which transfers the force to the valve stem 122. The force exerted on the valve stem 122 by the cam follower 126 is sufficient to overcome the bias of the spring, and the valve 54 is moved to its open position, as shown in FIG. 5B. The valve 54 returns to its closed position as the cam 110A rotates further such that the cam follower 126 contacts the base circle 130 and not the lobe 114, as understood by those skilled in the art.

Referring again to FIG. 4, line 134 represents an exemplary relationship between crank angle and displacement of the valve 54 from its closed position during a lift event, i.e., the movement of a valve from its closed position to its open position and its subsequent return to its closed position. Referring again to FIGS. 5A and 5B, the crank angle at which the lift event begins and the duration of the lift event is determined by the relationship between the position of the lobe 114 (with respect to the cam follower 126) and the speed cycle of the cam 110A. More specifically, the rotational speed of the cam 110A during a period in which the cam follower 126 engages the base circle portion 130 of the cam 110A determines the duration of time that the cam follower 126 engages the base circle portion 130 prior to engaging the lobe 114; that is, the faster the cam 110A rotates when the follower 126 engages the base circle 130, the sooner the lobe 114 rotates into a position to engage the cam follower 126 and cause the lift event. The speed of the cam 110A during a lift event determines the duration of the lift event; the faster the cam 110A rotates during a lift event, the sooner the lobe 114 rotates out of engagement with the cam follower 126.

Initial mounting positions of the eccentric gears 90A and 98A with respect to the cam 110A determine the "baseline" valve lift such as line 134 of FIG. 4. In an internal combustion engine with plurality of cylinders, the relative timing of the baseline valve events in different cylinders is determined by the number of cylinders. For example, there is a 180-degree crank angle peak-to-peak phase difference in valve-lift events in a 4 cylinder engine. To accommodate this, the input eccentric gear 90B should be mounted 90 degrees phased with respect to the input eccentric gear 90A in the two adjacent cylinders. Subsequently, the angular mounting position of the cam 110B with respect to the output eccentric gear 98B is the same as the angular mounting position of cam 110A with respect to the output eccentric gear 98A, ensuring same baseline valve event in both cylinders.

The timing of the lift event and the duration of the lift event are selectively variable by altering the relationship between the lobe position with respect to the cam follower and the speed cycle of the cam 110A. Referring again to FIG. 2, each of the intermediate shafts 94A, 94B is selectively rotatable about the support shaft 82 and axis A1. The valvetrain 62 includes actuators 140A, 140B, such as stepper motors, configured to selectively rotate intermediate shafts 94A, 94B, respectively, about axis A1 by different amounts.

Referring to FIG. 6, wherein like reference numbers refer to like components from FIGS. 1-5, the output eccentric gear 98A is shown in a "baseline" position with respect to the input eccentric gear 90A. The "baseline" position of the output eccentric gear 98A with respect to the input eccentric gear 90A, and the corresponding relationship between the cam lobe position and the speed cycle of the cam, may yield a "baseline" valve lift event as depicted by line 144 in FIG. 7A, which shows valve displacement with respect to crank angle. Actuator 140A (shown in FIG. 2) is configured to selectively rotate the axis of rotation A2 of gear 98A along an arc 136 of a circle having axis A1 at its center between the positions shown at A2L and A2R. Actuator 140A selectively rotates the axis of rotation A2 of gear 98A by selectively moving the intermediate member 94A along the arc 136 between the positions shown at 94AL and 94AR, with corresponding movement of the output eccentric gear 98A from its baseline position to positions shown at 98AL and 98AR.

In moving from the baseline position shown at 98A to the positions shown at 98AL and 98AR, the output eccentric gear rotates with respect to the input eccentric gear 90A, thereby altering the relationship between the output eccentric gear speed cycle, and correspondingly the cam speed cycle, and the position of the cam lobe 114 with respect to the cam follower 126.

Accordingly, by rotating the intermediate shaft 94A around the support shaft 82, valve opening timing and valve opening duration may be selectively altered. Referring to FIG. 7A, by rotating the output eccentric gear 98A with respect to the input eccentric gear 94A, the baseline valve lift event may be altered to the lift event depicted by line 144A, which provides a forty crank angle degree advance in valve opening compared to the baseline lift event and a longer valve opening duration in crank angle degrees compared to the baseline lift event 144. Similarly, the baseline lift event may be altered to the lift event depicted by line 144B in FIG. 7B.

Referring to FIG. 7B, the lift event depicted by line 144B provides a forty crank angle degree delay in valve opening compared to the baseline lift event 144 and a shorter valve opening duration in crank angle degrees compared to the base lift event. It should be noted that movement of the intermediate members 94A, 94B along arc 136 yields simultaneous variation in valve lift event duration and phasing in a fixed relationship, i.e., the duration change and phase change are coupled, and they are not independently controllable during engine operation. However, a desired relationship between valve lift event duration and phasing can be implemented by appropriately designing and configuring the geartrains 74A, 74B. For example, by appropriately designing the geartrains 74A, 74B, advancing the lift event can be coupled with either shorter, or longer lift event duration, and vice versa. It should also be noted that the cam speed profile can be selectively designed to be more or less aggressive, i.e., the amplitude deviation from the average speed value can be controlled by the gear 90A, 98A profiles. An aggressive profile will yield a larger variation in lift event duration with less phasing authority.

FIGS. 3A-6 depict input eccentric gear 90A, output eccentric gear 98A, and intermediate shaft 94A; however, it should be noted that input eccentric gear 90B, output eccentric gear 98B, and intermediate shaft 94B are substantially identical to input eccentric gear 90A, output eccentric gear 98A, and intermediate shaft 94A, although their rotational orientations at engine assembly will be different to accommodate the second cylinder firing at a different crank angle than the first cylinder. It should be noted that the phasing depicted in FIGS. 7A and 7B would differ from cylinder to cylinder in the embodiment depicted if the intermediate shafts 94A, 94B are adjusted the same amount. Accordingly multiple intermediate shafts are employed, one for each cylinder, and can be rotated around the support shaft by varying amounts. Although multiple actuators 140A, 140B are depicted, a single actuator may be employed within the scope of the claimed invention to drive a plurality of intermediate shafts 94A, 94B. The single actuator may be used in conjunction with differently sized gears meshing with properly-dimensioned gears integral to each intermediate shaft 94A, 94.

It should be noted that the valvetrain does not affect the maximum valve lift; accordingly, varying lift event duration at different cam speeds may be constrained, per valve spring, due to increased inertial loading. The valvetrain described herein enables late intake valve closing (LIVC) and late intake valve opening (LIVO) valve timing strategies to improve high-speed power and low-speed combustion stability. The valvetrain also enables early intake valve closing (EIVC) and early intake valve opening (EIVO) to improve part load efficiency (pumping loss reduction) and charge dilution control. The valvetrain may be advantageously employed in homogenous charge compression ignition (HCCI) engines.

While the best mode for carrying out the invention has been described in detail, those familiar with the art to which this invention relates will recognize various alternative designs and embodiments for practicing the invention within the scope of the appended claims.

The invention claimed is:

1. An engine characterized by variable valve timing comprising:

a rotatable crankshaft;

a first gear being operatively connected to the crankshaft to be driven thereby;

a second gear being meshingly engaged with the first gear to be driven thereby;

a rotatable cam operatively connected to the second gear to be driven thereby;

a valve being selectively movable between open and closed positions and being operatively connected to the cam such that rotation of the cam causes movement of the valve between the open and closed positions;

said first and second gears being configured such that the second gear and said cam are characterized by a varying speed when the crankshaft speed is constant;

a first member that rotatably supports the first gear;

a second member that rotatably supports the second gear;

a third gear mounted with respect to the second gear for rotation therewith; and a fourth gear being meshingly engaged with said third gear and being mounted with respect to the cam for rotation therewith; said third and fourth gears being characterized by a 1:1 ratio.

2. The engine of claim 1, wherein the first gear is rotatable about a first axis; wherein the second gear is rotatable about a second axis; wherein the second member is selectively movable such that the second axis is selectively movable with respect to the first axis to alter valve opening timing and duration.

3. The engine of claim 2, wherein the second member is selectively movable such that the second axis is selectively movable in an arc of a circle having the first axis at its center.

4. The engine of claim 2, further comprising an actuator configured to selectively move the second member.

5. The engine of claim 1, wherein the first and second gears are characterized by an elliptical shape.

6. The engine of claim 1, wherein the first and second gears are configured to mesh continuously through two rotations of the crankshaft.

7. The engine of claim 1, wherein said first and second gears are noncircular.

8. The engine of claim 1, wherein said first and second gears are eccentric.

9. An engine characterized by selectively variable valve timing comprising:

a rotatable crankshaft;

a support member;

first and second geartrains each having respective first and second gears being noncircular in shape, respective intermediate members, and respective cams;

said first gears of said first and second geartrains being rotatably supported by said support member for rotation about a first axis and being operatively connected to said crankshaft to be driven thereby;

said second gear of said first geartrain being meshingly engaged with said first gear of said first geartrain and supported by the intermediate member of the first geartrain for rotation about a second axis;

said cam of said first geartrain being operatively connected to said second gear of said first geartrain to be driven thereby;

said second gear of said second geartrain being meshingly engaged with said first gear of said second geartrain and supported by the intermediate member of said second geartrain for rotation about a third axis; and said cam of said second geartrain being operatively connected to said second gear of said second geartrain to be driven thereby.

10. The engine of claim 9, wherein said intermediate member of said first geartrain is selectively movable such that said second axis is selectively movable with respect to the first axis; and wherein said intermediate member of said second geartrain is selectively movable such that said third axis is selectively movable with respect to the first axis.

11. The engine of claim 10, wherein said intermediate member of said first geartrain is selectively movable such that said second axis is selectively movable along an arc of a circle having the first axis at its center; and wherein said intermediate member of said second geartrain is selectively movable such that said third axis is selectively movable along an arc of a circle having the first axis at its center.

12. The engine of claim 9, wherein the engine further comprises an input member being operatively connected to the crankshaft to be driven thereby;

wherein each of said first and second geartrains further includes respective third, fourth, fifth, and sixth gears;

said third gear of said first geartrain and said third gear of said second geartrain being mounted with respect to said input member to be driven thereby;

said fourth gear of said first geartrain being rotatably supported by said support member for rotation about the first axis, being meshingly engaged with said third gear of said first geartrain, and being mounted with respect to said first gear of said first geartrain for rotation therewith;

said fifth gear of said first geartrain being rotatably supported by said intermediate member of said first geartrain for rotation about said second axis and mounted with respect to said second gear of said first geartrain to be driven thereby;

said sixth gear of said first geartrain being rotatably supported by said support member for rotation about the first axis, being meshingly engaged with said fifth gear of said first geartrain, and being mounted with respect to said cam of said first geartrain for rotation therewith;

said fourth gear of said second geartrain being rotatably supported by said support member for rotation about the first axis, being meshingly engaged with said third gear of said second geartrain, and being mounted with respect to said first gear of said second geartrain for rotation therewith;

said fifth gear of said second geartrain being rotatably supported by said intermediate member of said second geartrain for rotation about said third axis and mounted with respect to said second gear of said second geartrain to be driven thereby; and said sixth gear of said second geartrain being rotatably supported by said support member for rotation about the first axis, being meshingly engaged with said fifth gear of said second geartrain, and being mounted with respect to said cam of said second geartrain for rotation therewith.

13. The engine of claim 9, wherein said first and second gears of said first and second geartrains are elliptical.

14. An engine characterized by variable valve timing comprising:

a rotatable crankshaft;

a first gear being operatively connected to the crankshaft to be driven thereby;

a second gear being meshingly engaged with the first gear to be driven thereby;

a rotatable cam operatively connected to the second gear to be driven thereby;

a valve being selectively movable between open and closed positions and being operatively connected to the cam such that rotation of the cam causes movement of the valve between the open and closed positions;

said first and second gears being configured such that the second gear and said cam are characterized by a varying speed when the crankshaft speed is constant;

wherein the first gear is rotatably connected to a first member and is rotatable about a first axis;

wherein the second gear is rotatably connected to a second member and is rotatable about a second axis;

wherein the second member is selectively movable such that the second axis is selectively movable with respect to the first axis to alter valve opening timing and duration; and a third gear mounted with respect to the second gear for rotation therewith, said first and third gears being configured such that the third gear is not disposed concentrically within the first gear.

15. The engine of claim 14, wherein the second member is selectively movable such that the second axis is selectively movable in an arc of a circle having the first axis at its center.

16. The engine of claim 14, further comprising an actuator configured to selectively move the second member.

* * * * *